US012297846B2

(12) United States Patent
Bando

(10) Patent No.: US 12,297,846 B2
(45) Date of Patent: May 13, 2025

(54) VACUUM PUMP

(71) Applicant: SHIMADZU CORPORATION, Kyoto (JP)

(72) Inventor: Ryuya Bando, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 18/733,975

(22) Filed: Jun. 5, 2024

(65) Prior Publication Data

US 2024/0410395 A1 Dec. 12, 2024

(30) Foreign Application Priority Data

Jun. 9, 2023 (JP) ..... 2023-095518

(51) Int. Cl.
*F04D 29/64* (2006.01)
*F04D 19/04* (2006.01)

(52) U.S. Cl.
CPC ..... *F04D 29/644* (2013.01); *F04D 19/042* (2013.01)

(58) Field of Classification Search
CPC ..... F04D 19/04; F04D 19/042; F04D 29/664
See application file for complete search history.

(56) References Cited

U.S. PATENT DOCUMENTS 5,971,725 A * 10/1999 de Simon ..... F04D 25/068 417/423.4
10,941,787 B2 * 3/2021 Sakai ..... F04D 19/042
2002/0131877 A1 * 9/2002 Omori ..... F04D 25/06 417/423.4
2020/0124043 A1 * 4/2020 Sakaguchi ..... F04B 39/00

FOREIGN PATENT DOCUMENTS

JP 2020148142 A * 9/2020
JP 2023-003070 A 1/2023

* cited by examiner

*Primary Examiner* — Justin D Seabe
*Assistant Examiner* — Jackson N Gillenwaters
(74) *Attorney, Agent, or Firm* — Renner, Otto, Boisselle & Sklar, LLP

(57) ABSTRACT

A vacuum pump includes a vacuum pump main body and a bottom fixing member. The vacuum pump main body has a bottom surface and a side surface. The side surface has a pump-side flat surface formed so as to extend from the bottom surface. The bottom fixing member is fastened to the bottom surface of the vacuum pump main body. The bottom fixing member has a fixing-side flat surface facing the pump-side flat surface.

4 Claims, 12 Drawing Sheets

VACUUM PUMP

CROSS-REFERENCE TO RELATED APPLICATIONS

This application claims priority under 35 U.S.C § 119 to Japanese Patent Application No. 2023-095518 filed on Jun. 9, 2023. The entire disclosure of Japanese Patent Application No. 2023-095518 is hereby incorporated herein by reference.

BACKGROUND OF THE INVENTION

Technical Field

The present invention relates to a vacuum pump.

Background Art

In the field of, e.g., a semiconductor manufacturing device, a turbo-molecular pump which is one type of vacuum pump is used for generating high vacuum atmosphere. In the turbo-molecular pump, a rotor rotates at high speed in a case, and for this reason, for the purpose of reducing transmission of energy upon breakdown of the rotor to a device side to which the turbo-molecular pump is connected, there has been disclosed a structure for absorbing such energy by deformation of a flange portion (see, for example, JP-A-2023-003070).

In some cases, in order to ensure strength against impact upon breakdown of a rotor of a vacuum pump, not only the upper side on which a flange is provided as in the above-described patent literature but also the bottom side are fixed. As a bottom-side fixing structure, for example, a vacuum pump main body is fastened to a bottom fixing plate with a pump fixing bolt, and the bottom fixing plate is fastened to a fixing target with a bottom fixing bolt.

SUMMARY OF THE INVENTION

However, strength withstanding impact of breakdown torque needs to be ensured for the bottom fixing bolt, and for this reason, the number of bolts, the strength of the bolt, and a bolt pitch circle diameter need to be ensured. This leads to an increase in the size of the bottom-side fixing structure.

An object of the present invention is to provide a vacuum pump configured so that a bottom-side fixing structure can be reduced in size.

A vacuum pump according to a first aspect of the present invention includes a vacuum pump main body and a bottom fixing member. The vacuum pump main body has a bottom surface and a side surface. The side surface has a first flat surface formed so as to extend from the bottom surface. The bottom fixing member is fastened to the bottom surface of the vacuum pump main body. The bottom fixing member has a second flat surface facing the first flat surface.

A vacuum pump according to a second aspect of the present invention includes a bottom surface and a side surface. The bottom surface is fastened to a fixing target. The side surface has a first flat surface formed so as to extend from the bottom surface. The first flat surface faces a second flat surface formed at the fixing target in a state in which the bottom surface is fastened to the fixing target.

According to the above-described aspects of the present invention, the vacuum pump can be provided, which is configured so that the bottom-side fixing structure of the vacuum pump can be reduced in size.

DETAILED DESCRIPTION OF THE EXEMPLARY EMBODIMENTS

Hereinafter, a vacuum pump system according to an embodiment of the invention will be described with reference to the drawings.

Configuration (Outline of Vacuum Pump 1)

Figure 1:
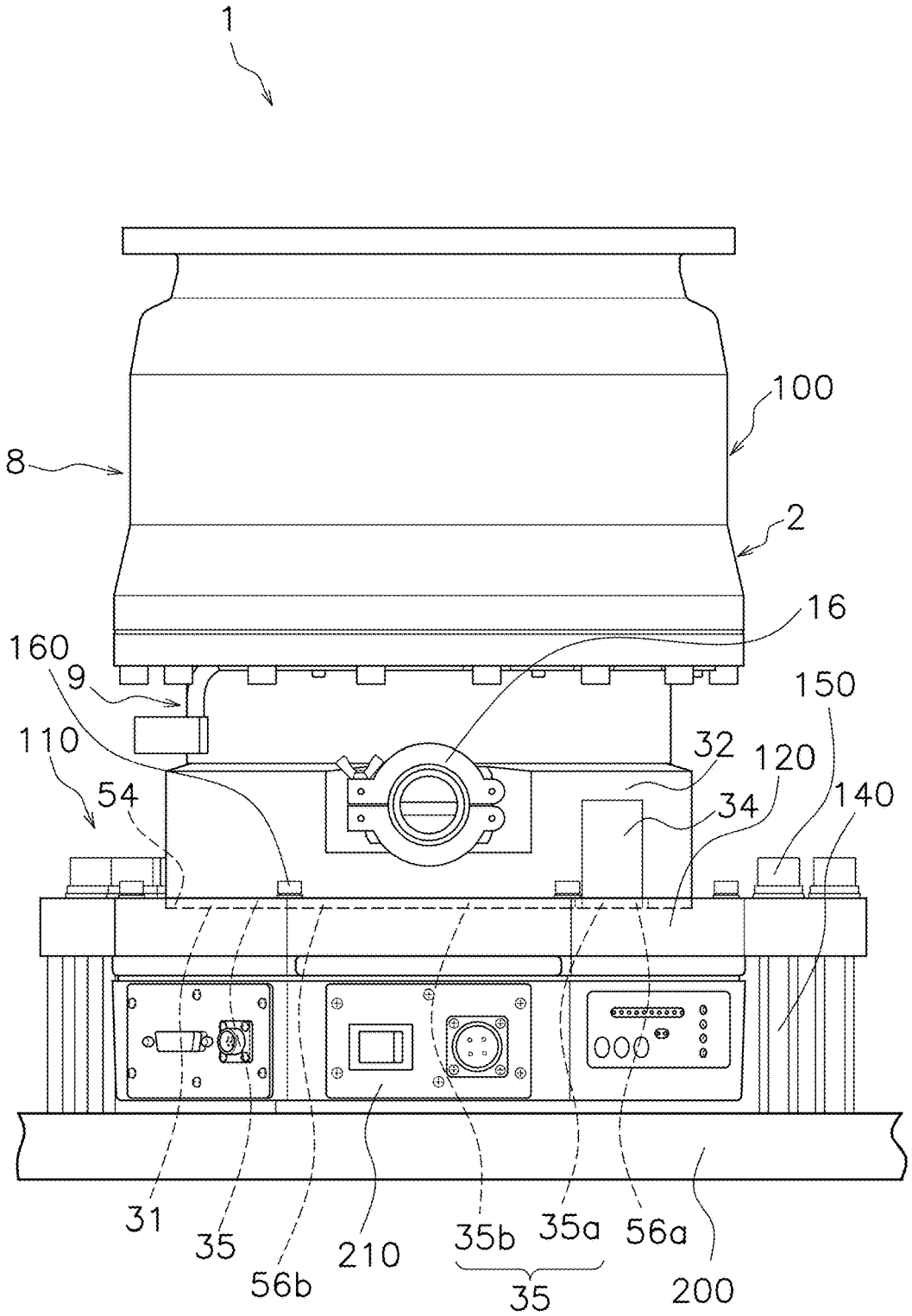
FIG. 1 is a front view of a vacuum pump according to an embodiment of the present invention.

FIG. 1 is a front view of a vacuum pump 1. The vacuum pump 1 includes a vacuum pump main body 100 and a bottom-side fixing structure 110. The vacuum pump main body 100 is connected to a chamber to pump gas from the chamber. The bottom-side fixing structure 110 fixes the bottom side of the vacuum pump main body 100 to a fixing target 200. The fixing target 200 is, for example, a support frame supporting the chamber, but is not limited thereto. Although details will be described later, the bottom-side fixing structure 110 has a bottom fixing plate 120. The vacuum pump main body 100 is fastened to the bottom fixing plate 120, and the bottom fixing plate 120 is fastened to the fixing target 200. In this manner, the vacuum pump main body 100 is fixed to the fixing target 200. In FIG. 1, a power source unit 210 for driving the vacuum pump main body 100 is arranged on the lower side of the bottom fixing plate 120.

(Vacuum Pump Main Body 100)

Figure 2:
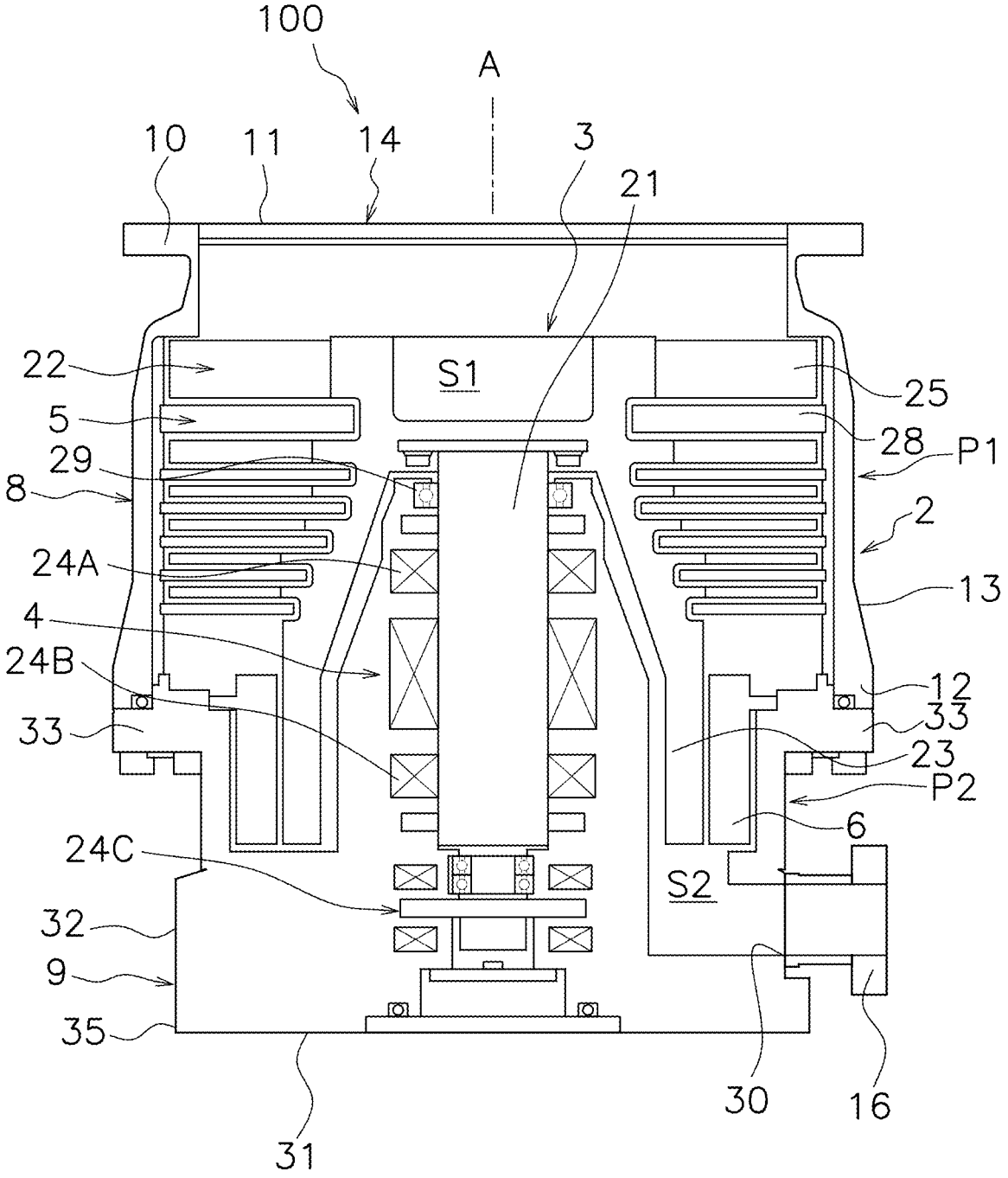
FIG. 2 is a view showing an internal configuration of a vacuum pump main body according to the embodiment of the present invention.

FIG. 2 is a sectional view of the vacuum pump main body 100 according to an embodiment.

The vacuum pump main body 100 includes a turbine portion P1 and a drag pump portion P2. The turbine portion P1 forms a turbo-molecular pump. The drag pump portion P2 forms a screw groove pump. The vacuum pump main body 100 is connected to the chamber. Gas from the chamber is discharged by the turbine portion P1, and thereafter, is discharged by the drag pump portion P2. Then, the gas is discharged to the outside of the vacuum pump main body 100.

As shown in FIG. 2, the vacuum pump main body 100 has a housing 2, a rotor 3, a motor 4, a plurality of stator blade units 5, and a stator cylindrical portion 6. The housing 2 houses the rotor 3, the motor 4, the plurality of stator blade units 5, and the stator cylindrical portion 6.

The housing 2 has a case 8, a base 9, and a fixed flange 10. The housing 2 is made of metal such as aluminum alloy or iron. The case 8 is a tubular member having the fixed flange 10 at one end.

The case 8 houses the plurality of stator blade units 5 and plural stages of rotor blade units 22 provided in the rotor 3. The case 8 has a first end portion 11, a second end portion 12, and a side surface 13.

The first end portion 11 is attached to a pumping target device. A suction port 14 is provided in the first end portion 11. The second end portion 12 is positioned opposite to the fixed flange 10 in the direction of the center axis A of the rotor 3. The second end portion 12 is connected to the base 9. The side surface 13 is provided between the first end portion 11 and the second end portion 12. A first internal space S1 is formed inside the case 8.

The base 9 is arranged so as to close an opening of the case 8 on the second end portion 12 side. The base 9 houses the stator cylindrical portion 6 and a rotor cylindrical portion 23 provided in the rotor 3. The base 9 is connected to the second end portion 12 of the case 8 at a base end portion 33. A second internal space S2 is formed inside the base 9. The second internal space S2 communicates with the first internal space S1. An exhaust port 30 is formed in a side surface 32 of the base 9. A connector 16 to be connected to an exhaust pipe is arranged in the exhaust port 30. The exhaust port 30 communicates with the second internal space S2. The configuration of the base 9 will be further described later.

The fixed flange 10 is connected to the case 8. The fixed flange 10 protrudes from the case 8. The fixed flange 10 is fixed to the pumping target device with a bolt. Note that "connect" includes joining of separate members. Further, "connect" includes continuous formation of separate portions in an integrated member.

The rotor 3 has a shaft 21, the plural stages of rotor blade units 22, and the rotor cylindrical portion 23. The shaft 21 extends along the axis A of the rotor 3. In description below, in the direction along the axis A, a direction from the case 8 to the base 9 will be defined as below, and the opposite direction thereof will be defined as above.

The vacuum pump main body 100 includes a protection bearing 29 and a plurality of bearings 24A to 24C. The protection bearing 29 functions as a touchdown bearing configured to limit radial runout of the upper side of the shaft 21. The protection bearing 29 is attached to the base 9. In a state in which the shaft 21 is in steady rotation, the shaft 21 does not contact the protection bearing 29. When great disturbance is applied or whirling of the shaft 21 becomes greater upon acceleration or deceleration of rotation, the shaft 21 contacts the inner surface of an inner ring of the protection bearing 29. For example, a ball bearing can be used as the protection bearing 29.

The plurality of bearings 24A to 24C rotatably supports the rotor 3. The plurality of bearings 24A to 24C is attached to the base 9. The plurality of bearings 24A to 24C includes, for example, a magnetic bearing. Note that the plurality of bearings 24A to 24C may include other types of bearings such as a ball bearing.

Each of the plural stages of rotor blade units 22 is connected to the shaft 21. The plural stages of rotor blade units 22 are arranged at intervals in the direction along the axis A. Each rotor blade unit 22 includes a plurality of rotor blades 25. Although not shown in the figure, each of the plurality of rotor blades 25 radially extends about the shaft 21. Note that in the drawing, reference numerals are assigned only to one of the plural stages of rotor blade units 22 and one of the plurality of rotor blades 25 and no reference numerals are assigned to the other rotor blade units 22 and the other rotor blades 25.

The rotor cylindrical portion 23 is connected to the shaft 21. The rotor cylindrical portion 23 is arranged below the rotor blade units 22. The rotor cylindrical portion 23 is in a cylindrical shape, and extends in the direction along the axis A. The rotor cylindrical portion 23 is arranged so as to surround the shaft 21 on the outer peripheral side of the shaft 21.

The motor 4 rotationally drives the rotor 3. For example, a DC brushless motor is used as the motor 4. The motor 4 has a motor rotor and a motor stator. For example, the motor rotor is attached to the shaft 21. The motor stator is attached to the base 9. The motor stator is arranged so as to face the motor rotor.

The plural stages of stator blade units 5 are connected to the inner surface of the case 8. The plural stages of stator blade units 5 are arranged at intervals in the direction along the axis A. Each of the plural stages of stator blade units 5 is arranged between adjacent ones of the plural stages of rotor blade units 22. Each stator blade unit 5 includes a plurality of stator blades 28. Although not shown in the figure, each of the plurality of stator blades 28 radially extends about the shaft 21.

The plural stages of rotor blade units 22 and the plural stages of stator blade units 5 form the turbine portion P1 (turbo-molecular pump). Note that in the drawing, reference numerals are assigned only to one of the plurality of stator blade units 5 and one of the plurality of stator blades 28 and no reference numerals are assigned to the other stator blade units 5 and the stator blades 28.

The stator cylindrical portion 6 is arranged on the outside of the rotor cylindrical portion 23 in the radial direction. The stator cylindrical portion 6 is connected to the base 9. The stator cylindrical portion 6 is arranged so as to face the rotor cylindrical portion 23 in the radial direction of the rotor cylindrical portion 23.

A spiral screw groove is provided in the inner peripheral surface of the stator cylindrical portion 6. The rotor cylindrical portion 23 and the stator cylindrical portion 6 form the drag pump portion P2 (screw groove pump). Note that the spiral screw groove is not necessarily provided in the inner peripheral surface of the stator cylindrical portion 6, but may be provided in the outer peripheral surface of the rotor cylindrical portion 23.

(Base 9)

Figure 3:
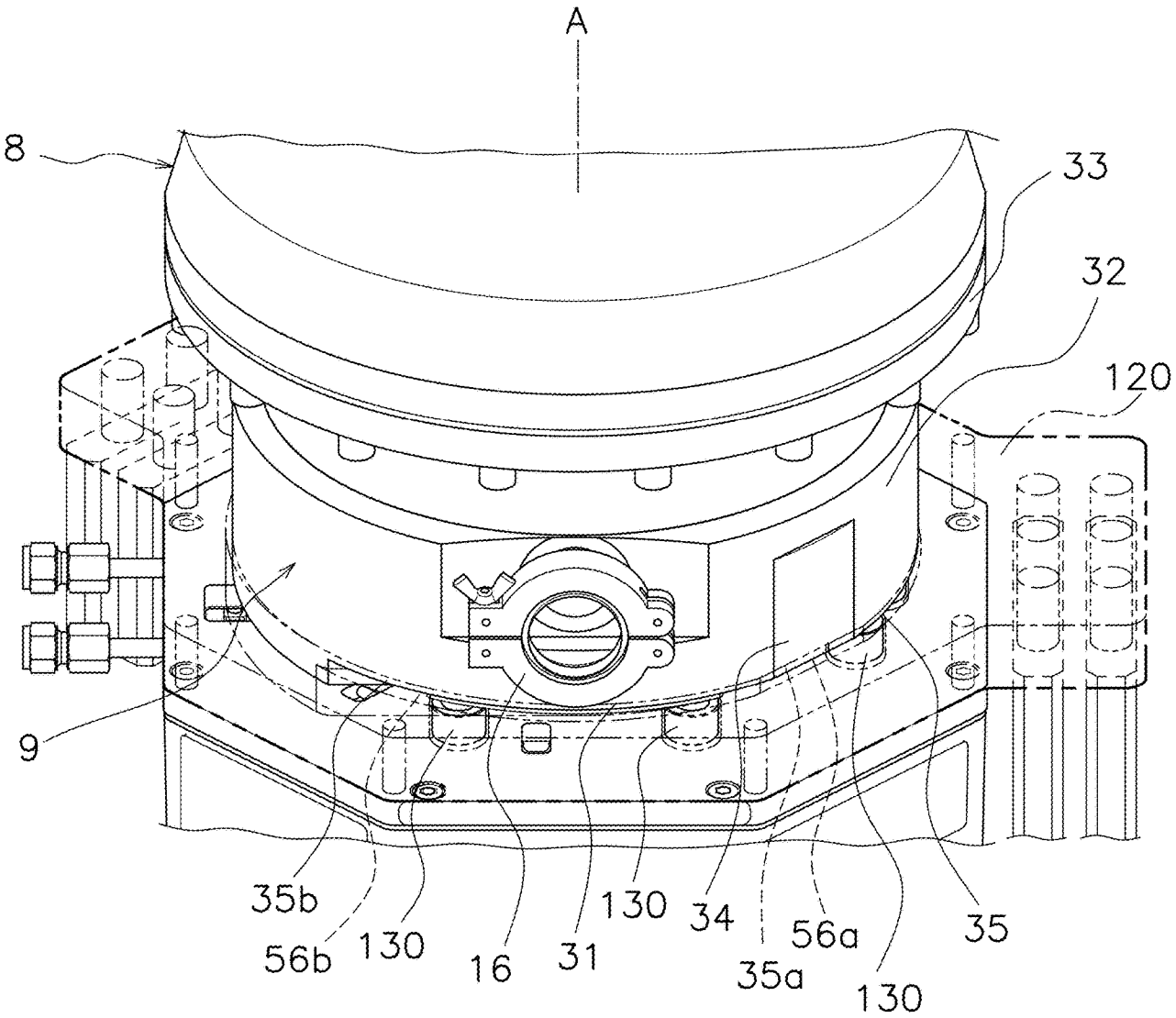
FIG. 3 is a perspective view showing the vicinities of a base of the vacuum pump main body and a bottom-side fixing structure according to the embodiment of the present invention.
Figure 4A:
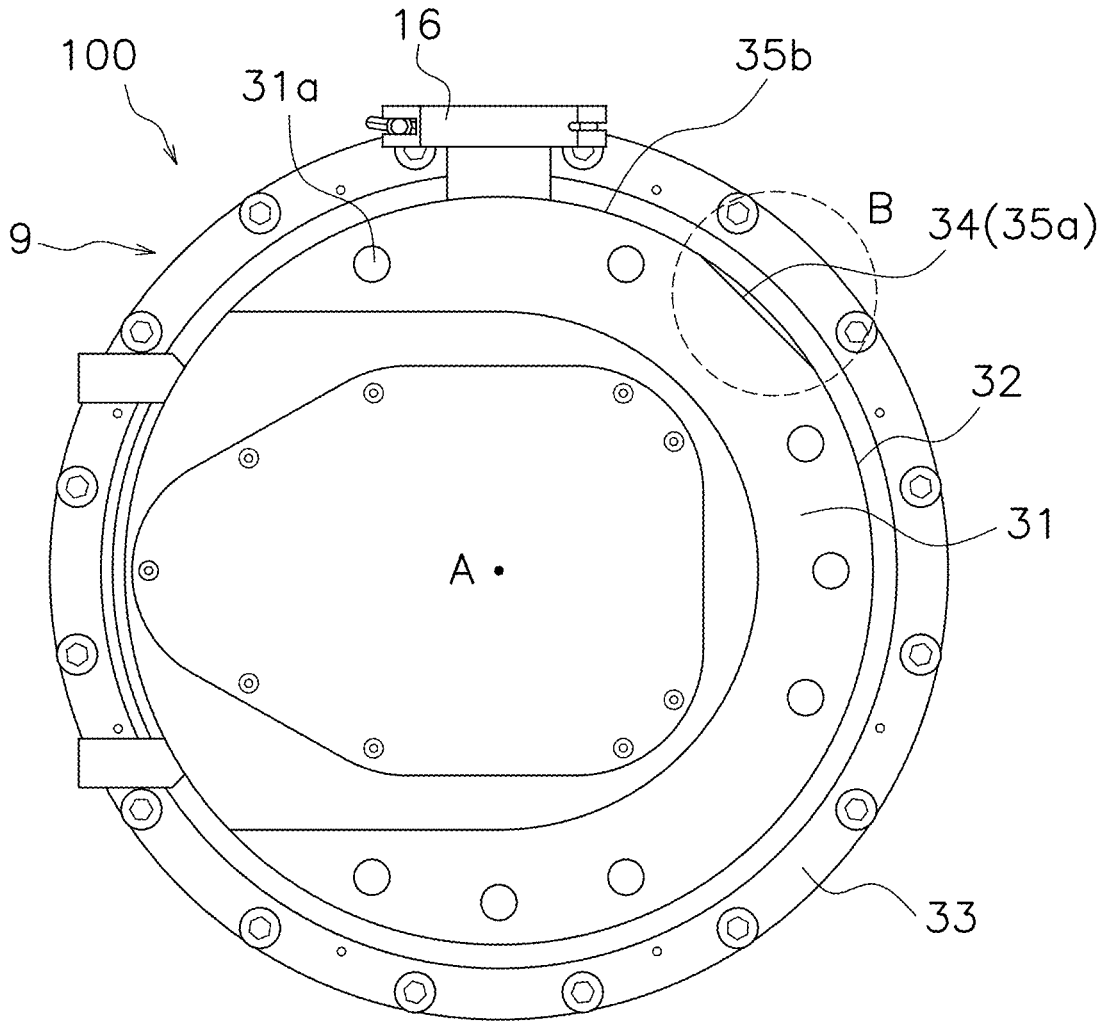
FIG. 4A is a bottom view of the vacuum pump main body according to the embodiment of the present invention.
Figure 4B:
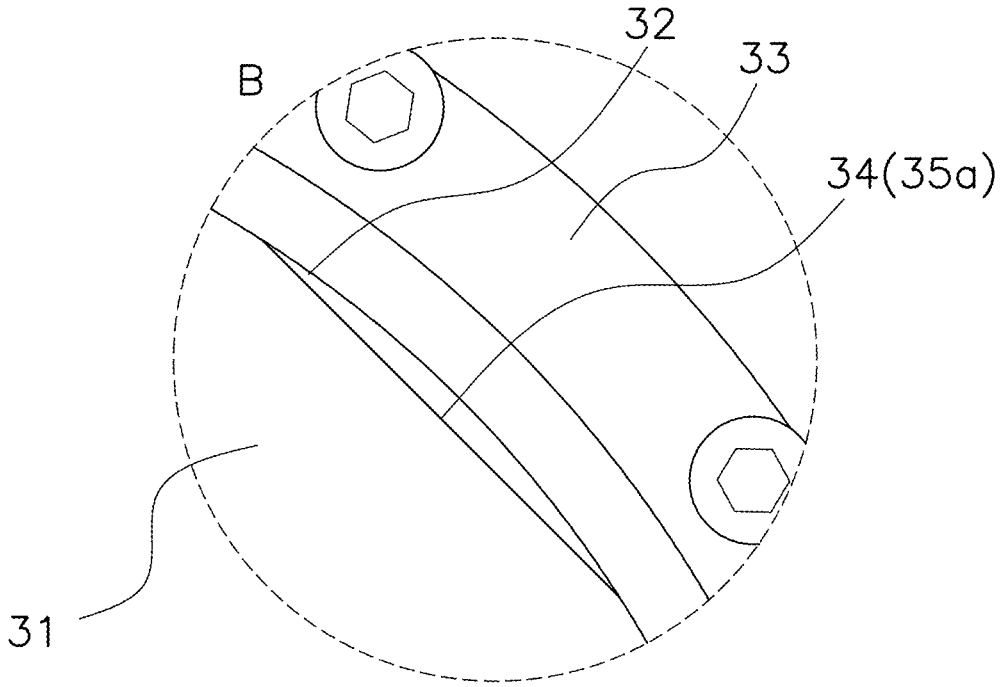
FIG. 4B is an enlarged view of a portion B of FIG. 4A.

FIG. 3 is a perspective view showing the vicinities of the base 9 and the bottom fixing plate 120. In FIG. 3, the bottom fixing plate 120 is indicated by a dash-dot-dot line. FIG. 4A is a bottom view of the vacuum pump main body 100. FIG. 4B is an enlarged view of a portion B of FIG. 4A.

The base 9 is in a substantially cylindrical shape having a bottom. As shown in FIG. 2, the base 9 has a bottom surface 31, the side surface 32, and the base end portion 33. The bottom surface 31 is fixed to the bottom fixing plate 120.

As shown in FIG. 4A, a plurality of bolt holes 31*a* into which later-described pump fixing bolts 130 are to be inserted is formed in the bottom surface 31. The bolt holes 31*a* are arranged on a circumference about the axis A. An internal thread to be screwed with an external thread of the pump fixing bolt 130 is formed at the inner peripheral surface of the bolt hole 31*a*. In the present embodiment, eight bolt holes 31*a* are formed, but a reference numeral is assigned only to one of the bolt holes 31*a* in FIG. 4A.

The side surface 32 is arranged so as to extend toward the suction port 14 from the periphery of the bottom surface 31. The base end portion 33 is arranged at the end of the side surface 32 on the suction port 14 side. The base end portion 33 protrudes outward (direction apart from the axis A) from the side surface 32. As shown in FIGS. 2 and 3, the base end portion 33 is connected to the second end portion 12 of the case 8.

The outer shape of the side surface 32 is such a shape that columns having substantially different outer diameters are arranged one above the other. The side surface 32 is formed such that the outer diameter thereof is greater on the bottom surface 31 side than on the suction port 14 side. The side surface 32 has a pump-side flat surface 34 (first flat surface). The outer shape of the side surface 32 is not limited to above, and may be a cylindrical shape with the same diameter.

As shown in FIGS. 3, 4A, and 4B, the pump-side flat surface 34 is connected to the bottom surface 31. The pump-side flat surface 34 is formed upward (suction port 14 side) from the end of the bottom surface 31. The pump-side flat surface 34 is arranged in parallel with the axis A. When the vacuum pump main body 100 is fixed to the bottom fixing plate 120, the pump-side flat surface 34 faces a fixing-side flat surface 56*a* (second flat surface) of the bottom fixing plate 120 described later.

As shown in FIG. 3, a portion of the side surface 32 located in the vicinity of the bottom surface 31 and fitted in a recessed portion 54 of the bottom fixing plate 120 described later is a side lower end portion 35. The side lower end portion 35 has a flat portion 35*a* and a curved portion 35*b*. The flat portion 35*a* is part of the pump-side flat surface 34 (see FIG. 7B described later). The curved portion 35*b* is a portion of the side lower end portion 35 other than the flat portion 35*a*. As shown in FIG. 4A, in plan view, the curved portion 35*b* is formed on the same circumference about the axis A. The flat portion 35*a* is on a straight line. The flat portion 35*a* overlaps with the pump-side flat surface 34 in plan view, and therefore, a reference numeral for the flat portion 35*a* is in parentheses in FIG. 4A.

(Bottom-Side Fixing Structure 110)

As shown in FIG. 1, the bottom-side fixing structure 110 includes the bottom fixing plate 120 (bottom fixing member), the pump fixing bolts 130 (first fastening member) (see FIG. 3), a bottom fixing tool 140, and bottom fixing bolts 150 (second fastening member). As shown in FIG. 3, the bottom fixing plate 120 is fastened to the vacuum pump main body 100 with the pump fixing bolts 130. The bottom fixing tool 140 is arranged between the bottom fixing plate 120 and the fixing target 200. The bottom fixing bolts 150 are inserted from above through the bottom fixing plate 120 and the bottom fixing tool 140 until reaching the fixing target 200. The bottom fixing bolt 150 is arranged in parallel with the axis A. With this configuration, the vacuum pump main body 100 can be fixed to the fixing target 200.

Figure 5:
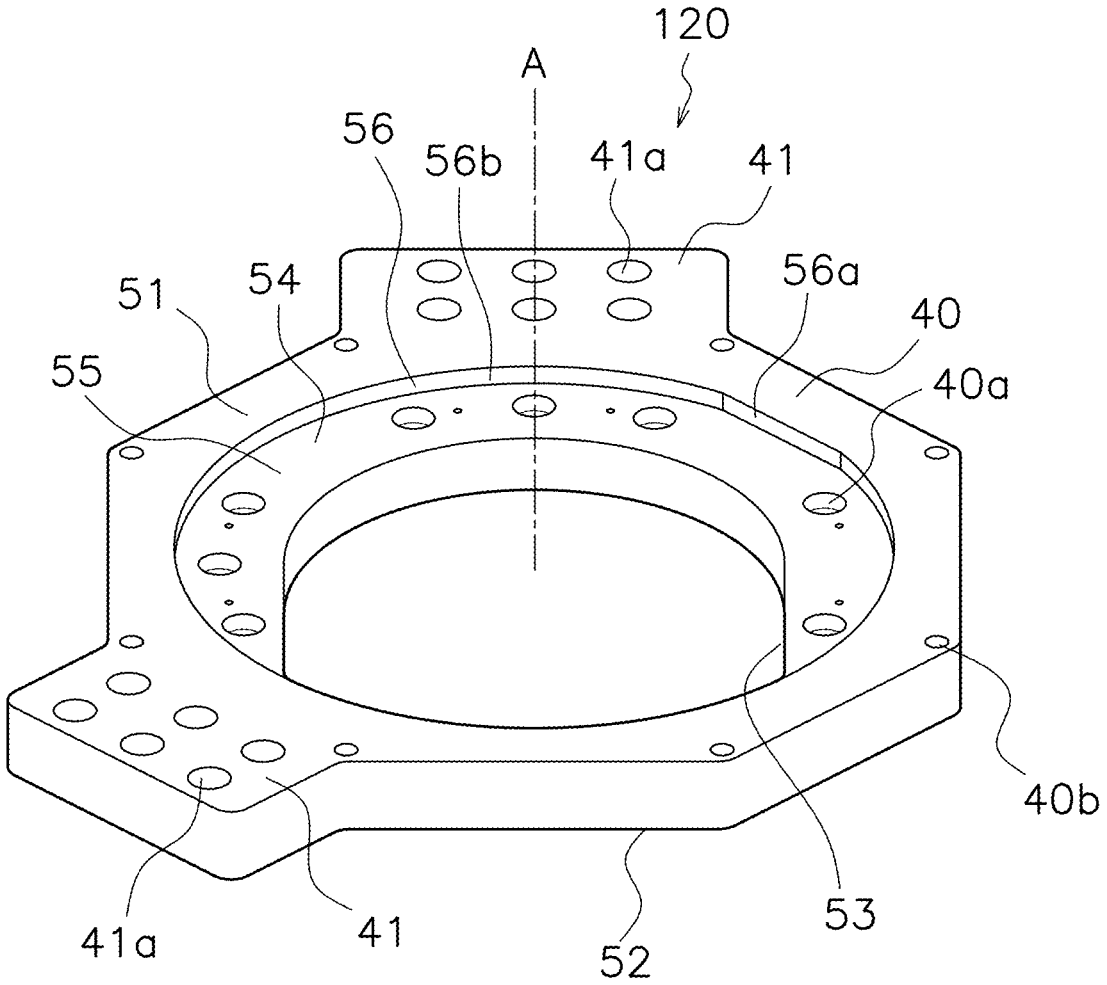
FIG. 5 is a perspective view of a bottom fixing plate according to the embodiment of the present invention.
Figure 6A:
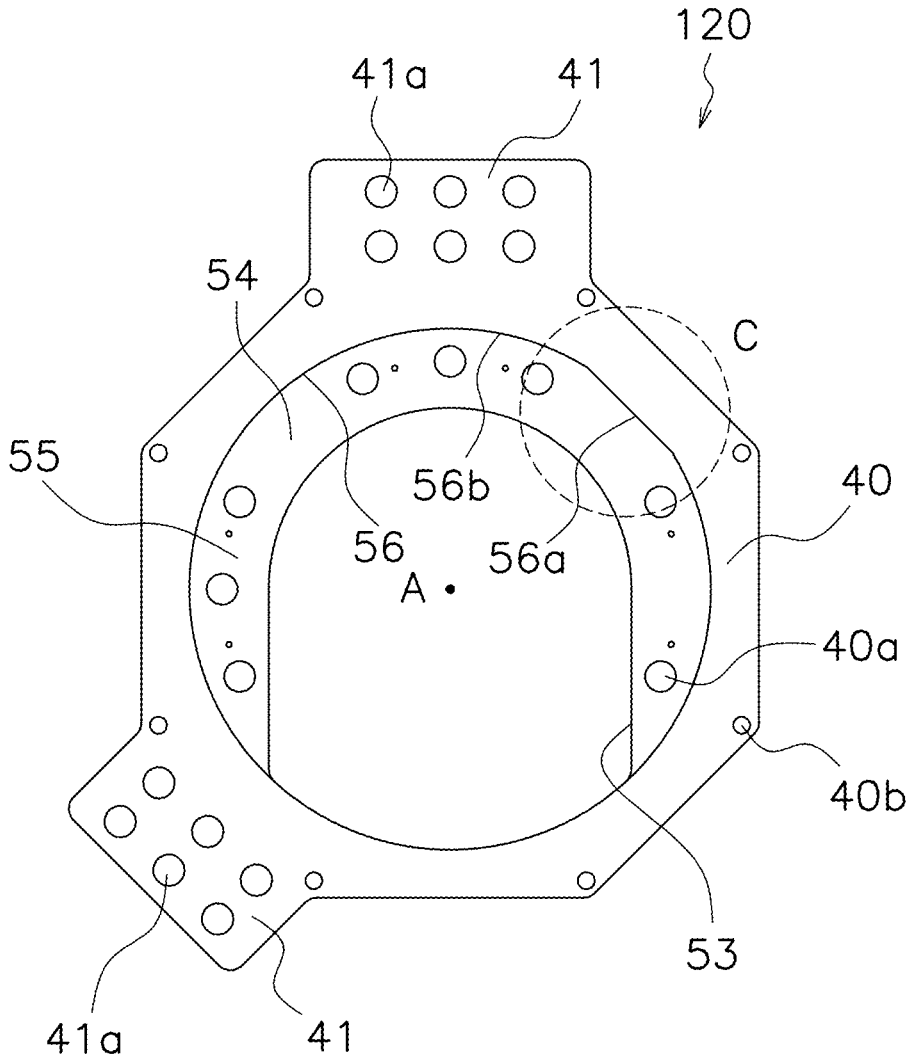
FIG. 6A is a top view of the bottom fixing plate according to the embodiment of the present invention.
Figure 6B:
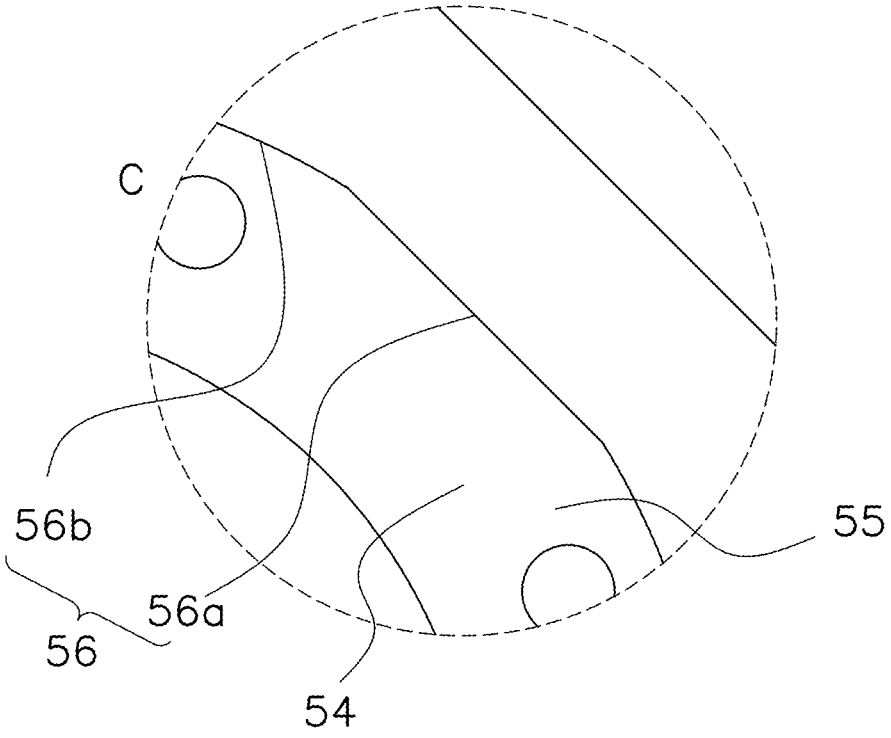
FIG. 6B is an enlarged view of a portion C of FIG. 6A.

FIG. 5 is a perspective view of the bottom fixing plate 120. FIG. 6A is a top view of the bottom fixing plate 120. FIG. 6B is an enlarged view of a portion C of FIG. 6A.

The bottom fixing plate 120 has a main body portion 40 and a plurality of protruding portions 41. The main body portion 40 is in a plate shape. The main body portion 40 has a first surface 51, a second surface 52, an opening 53, and the recessed portion 54. The first surface 51 is a surface on a side on which the vacuum pump main body 100 is to be mounted. The second surface 52 is a surface on a side on which the fixing target 200 is to be arranged.

The opening 53 penetrates the main body portion 40 from the first surface 51 to the second surface 52. The opening 53 is provided for inserting, e.g., a cable extending from the power source unit 210 to the vacuum pump main body 100.

The recessed portion 54 is formed in the first surface 51. The bottom surface 31 and side lower end portion 35 of the vacuum pump main body 100 are fitted in the recessed portion 54. The recessed portion 54 is formed with the opening 53. The recessed portion 54 has a mount surface 55 and an inner peripheral surface 56. The bottom surface 31 of the vacuum pump main body 100 is mounted on the mount surface 55. The inner peripheral surface 56 is formed upward from the peripheral edge of the mount surface 55. The inner peripheral surface 56 faces the side lower end portion 35 of the vacuum pump main body 100.

The inner peripheral surface 56 includes the fixing-side flat surface 56*a* and a curved surface 56*b*. The fixing-side flat surface 56*a* faces the flat portion 35*a* when the vacuum pump main body 100 is mounted in the recessed portion 54. Since the flat portion 35*a* is included in the pump-side flat surface 34, it can be said that the fixing-side flat surface 56*a* faces the pump-side flat surface 34. As shown in FIG. 5, the fixing-side flat surface 56*a* is formed in a rectangular shape as viewed in a direction perpendicular to the axis A. The curved surface 56*b* is formed along the above-described curved portion 35*b* of the vacuum pump main body 100. As shown in FIG. 6A, the curved surface 56*b* is formed on a circumference with the same radius about the axis A in plan view. As shown in FIG. 6B, in plan view, the fixing-side flat surface 56*a* is formed on a straight line.

A plurality of through-holes 40*a* penetrating the main body portion 40 from the second surface 52 to the mount surface 55 is formed in the main body portion 40. The through-holes 40*a* are arranged on a circumference about the axis A. In the present embodiment, eight through-holes 40*a* are formed, but a reference numeral is assigned only to one of the through-holes 40*a* in the figure. For example, the inner peripheral surface of the through-hole 40*a* is a smooth curved surface, and is formed with no internal thread shape. The pump fixing bolt 130 (see FIG. 3) is inserted into the bolt hole 31*a* of the bottom surface 31 of the vacuum pump main body 100 from below through the through-hole 40*a* of the bottom fixing plate 120. The pump fixing bolt 130 is arranged in parallel with the axis A. The external thread of the outer periphery of the pump fixing bolt 130 (one example of a fastening member) is screwed with the internal thread of the inner periphery of the bolt hole 31*a*. With this configuration, the vacuum pump main body 100 can be fixed to the bottom fixing plate 120.

A plurality of through-holes 40*b* penetrating the main body portion 40 from a portion of the first surface 51 outside the recessed portion 54 to the second surface 52 is provided in the main body portion 40. The plurality of through-holes 40*b* is arranged on a circumference about the axis A. In the present embodiment, eight through-holes 40*b* are formed, but a reference numeral is assigned only to one of the through-holes 40*b* in the figure. For example, the inner peripheral surface of the through-hole 40*b* is a smooth curved surface, and is formed with no internal thread shape.

The through-holes 40*b* are arranged along the periphery of the main body portion 40. A bolt 160 shown in FIG. 1 is inserted into a bolt hole formed in the upper surface of the power source unit 210 through the through-hole 40*b*. An external thread of the outer periphery of the bolt 160 is screwed with an internal thread of the inner periphery of the bolt hole.

The plurality of protruding portions 41 protrudes outward from the outer periphery of the main body portion 40. In the present embodiment, two protruding portions 41 are provided. Each protruding portion 41 is in a plate shape. In each protruding portion 41, a plurality of through-holes 41*a* into which the bottom fixing bolts 150 are to be inserted is formed. In the present embodiment, six through-holes 41*a* are formed in one protruding portion 41, but a reference numeral is assigned only to one of the through-holes 41*a* in the figure. The bottom fixing tool 140 is arranged between the through-holes 41*a* and the fixing target 200. The bottom fixing tool 140 is in a cylindrical shape. For example, the inner peripheral surface of the through-hole 41*a* and the inner periphery of the bottom fixing tool 140 are smooth curved surfaces, and are formed with no internal thread shape. The bottom fixing bolt 150 is inserted into the fixing target 200 from above through the through-hole 41*a* of the protruding portion 41 and the inside of the bottom fixing tool 140. The bottom fixing bolt 150 is arranged in parallel with the axis A. An external thread of the outer periphery of the bottom fixing bolt 150 is screwed with an internal thread of the inner periphery of a bolt hole of the fixing target 200. With this configuration, the bottom fixing plate 120 can be fixed to the fixing target 200.

In the vacuum pump 1 of the present embodiment, the pump-side flat surface 34 of the vacuum pump main body 100 and the fixing-side flat surface 56*a* of the bottom fixing plate 120 are provided as flat surfaces facing each other. Thus, the pump-side flat surface 34 contacts the fixing-side flat surface 56*a* upon breakdown of the rotor, and therefore, the bottom fixing plate 120 can receive breakdown torque by the surface and breakdown torque on the bottom fixing bolt 150 can be reduced.

Figure 7A:
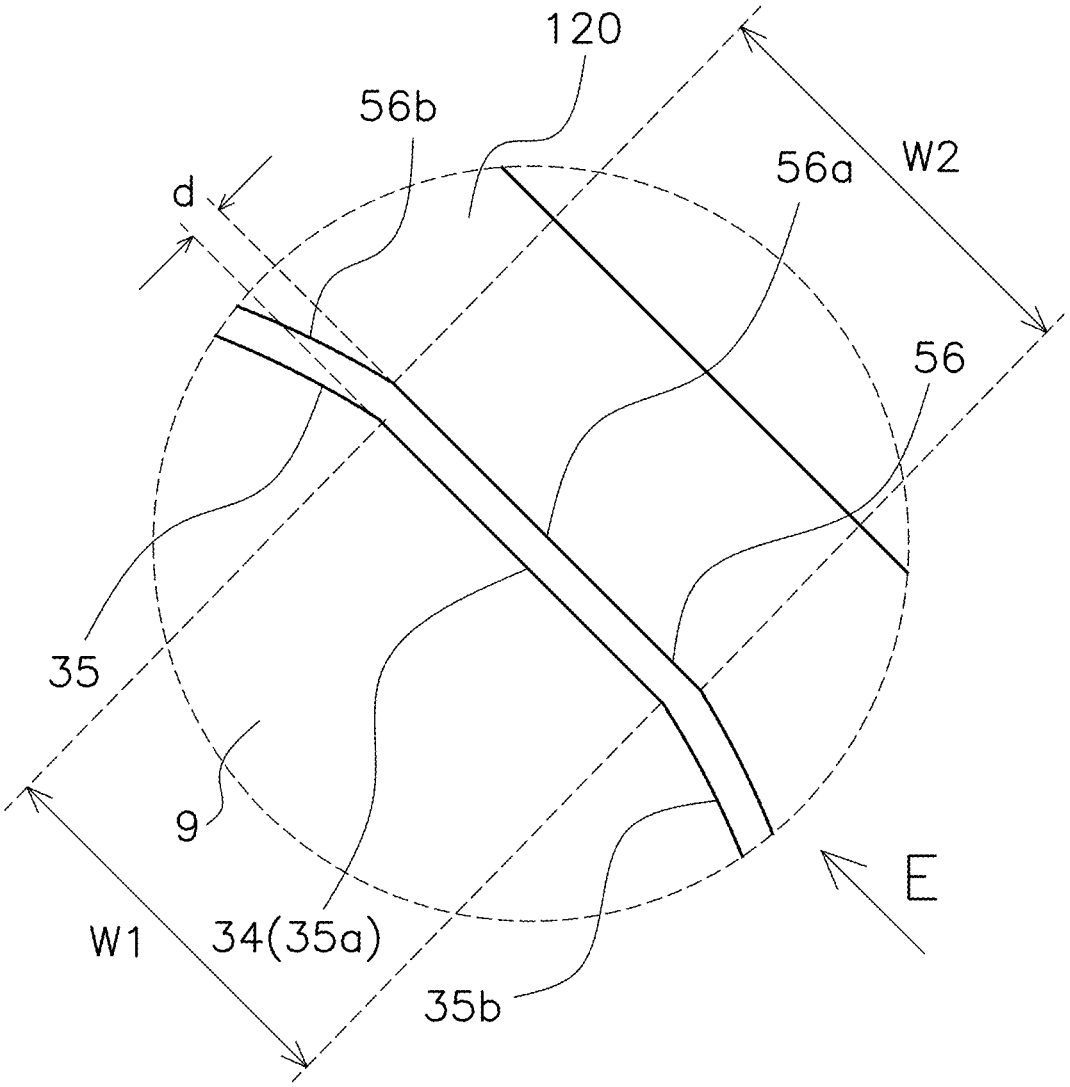
FIG. 7A is a schematic plan view showing a positional relationship between a pump-side flat surface and a fixing-side flat surface in the vacuum pump according to the embodiment of the present invention.
Figure 7B:
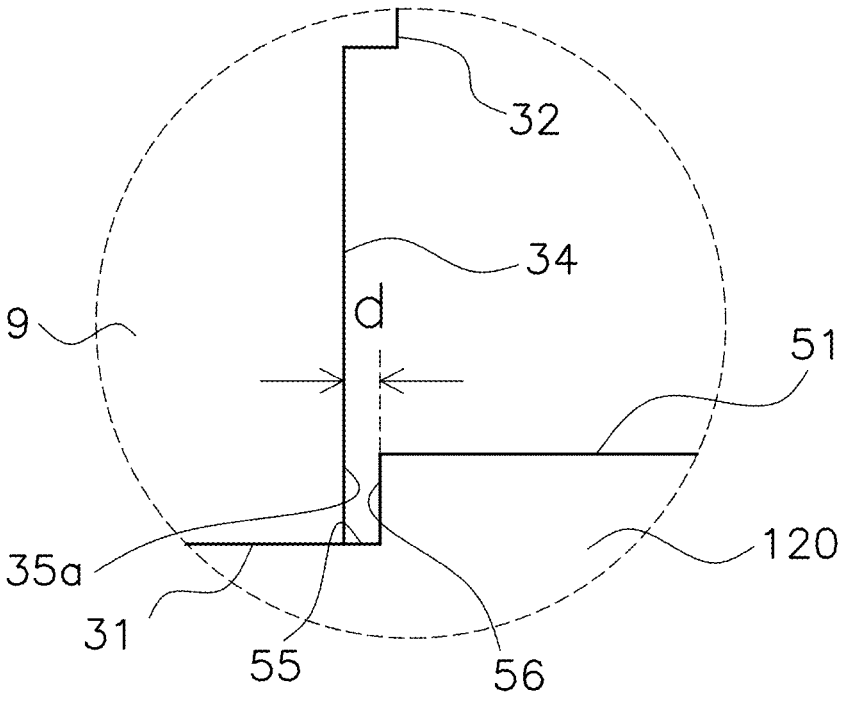
FIG. 7B is a schematic view of FIG. 7A along an arrow E.

There is a clearance between the inner peripheral surface 56 of the bottom fixing plate 120 and the side lower end portion 35. FIG. 7A is a schematic plan view showing a positional relationship between the pump-side flat surface 34 and the fixing-side flat surface 56*a*. FIG. 7A is one additionally showing the side lower end portion 35 in FIG. 6B. FIG. 7B is a schematic view of FIG. 7A along an arrow E. A clearance d between the pump-side flat surface 34 and the fixing-side flat surface 56*a* is formed smaller than a clearance between the inner peripheral surface of the through-hole 41*a* of the bottom fixing plate 120 and the bottom fixing bolt 150. Moreover, the clearance d is preferably smaller than a smallest one of a plurality of clearances between the bottom fixing bolt 150 and the inner peripheral surface of the through-hole 41*a*. With this configuration, upon breakdown of the rotor 3, the pump-side flat surface 34 contacts the fixing-side flat surface 56*a* before the bottom fixing bolt 150 contacts the through-hole 41*a*, and therefore, the breakdown torque on the bottom fixing bolt 150 can be reduced.

Assuming that the width of the pump-side flat surface 34 in plan view is W1 and the width of the fixing-side flat surface 56*a* is W2, W2 is preferably greater than W1. The widths W1, W2 and the clearance d are preferably set such that the pump-side flat surface 34 contacts the fixing-side flat surface 56*a* when the vacuum pump main body 100 rotates about the axis A relative to the bottom fixing plate 120.

Other Embodiments

One embodiment of the present invention has been described above, but the present invention is not limited to the above-described embodiment and various changes can be made without departing from the gist of the invention.

In the above-described embodiment, only one pair of the pump-side flat surface 34 and the fixing-side flat surface 56*a* is provided, but plural pairs may be provided.

In the above-described embodiment, the pump-side flat surface 34 extends to the position higher than the fixing-side flat surface 56*a*, but may be formed to a portion (flat portion 35*a*) at the same height as that of the fixing-side flat surface 56*a*.

Figure 8:
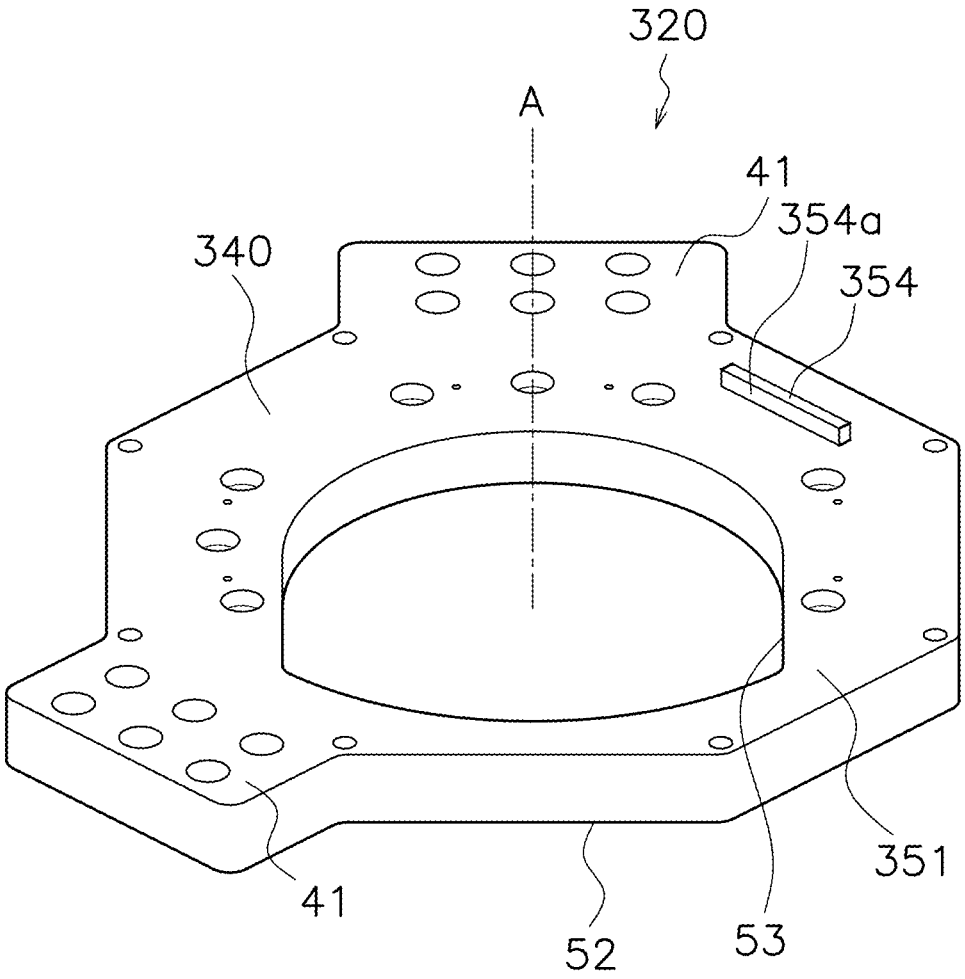
FIG. 8 is a perspective view of a bottom fixing plate according to a modification of the embodiment of the present invention.

In the above-described embodiment, the recessed portion 54 is formed in the bottom fixing plate 120, and the fixing-side flat surface 56*a* facing the pump-side flat surface 34 is provided at the inner peripheral surface 56 of the recessed portion 54. However, the present invention is not limited to this configuration. FIG. 8 is a perspective view showing a bottom fixing plate 320 of a modification. The bottom fixing plate 320 is formed with no recessed portion 54 in a first surface 351 of a main body portion 340 as compared to the bottom fixing plate 120. The bottom fixing plate 320 has a raised portion 354 on the first surface 351. The raised portion 354 has a fixing-side flat surface 354*a* facing inward. The fixing-side flat surface 354*a* faces the pump-side flat surface 34 when the vacuum pump main body 100 is fixed to the bottom fixing plate 320. As described above, the surface facing the pump-side flat surface 34 is not necessarily provided at the inner peripheral surface 56 of the recessed portion 54, but may be provided at the raised portion 354.

In the above-described embodiment, the two protruding portions 41 are provided, and the six through-holes 41*a* are formed in each protruding portion 41. However, the present invention is not limited to these numbers. Similarly, the numbers of through-holes 40*a*, 40*b* are not limited to eight as described above.

In the above-described embodiment, the power source unit 210 is arranged on the lower side of the bottom fixing plate 120, and the bottom fixing plate 120 and the power source unit 210 are fastened to each other with the bolts. However, the power source unit 210 is not necessarily arranged on the lower side of the bottom fixing plate 120.

Figure 9:
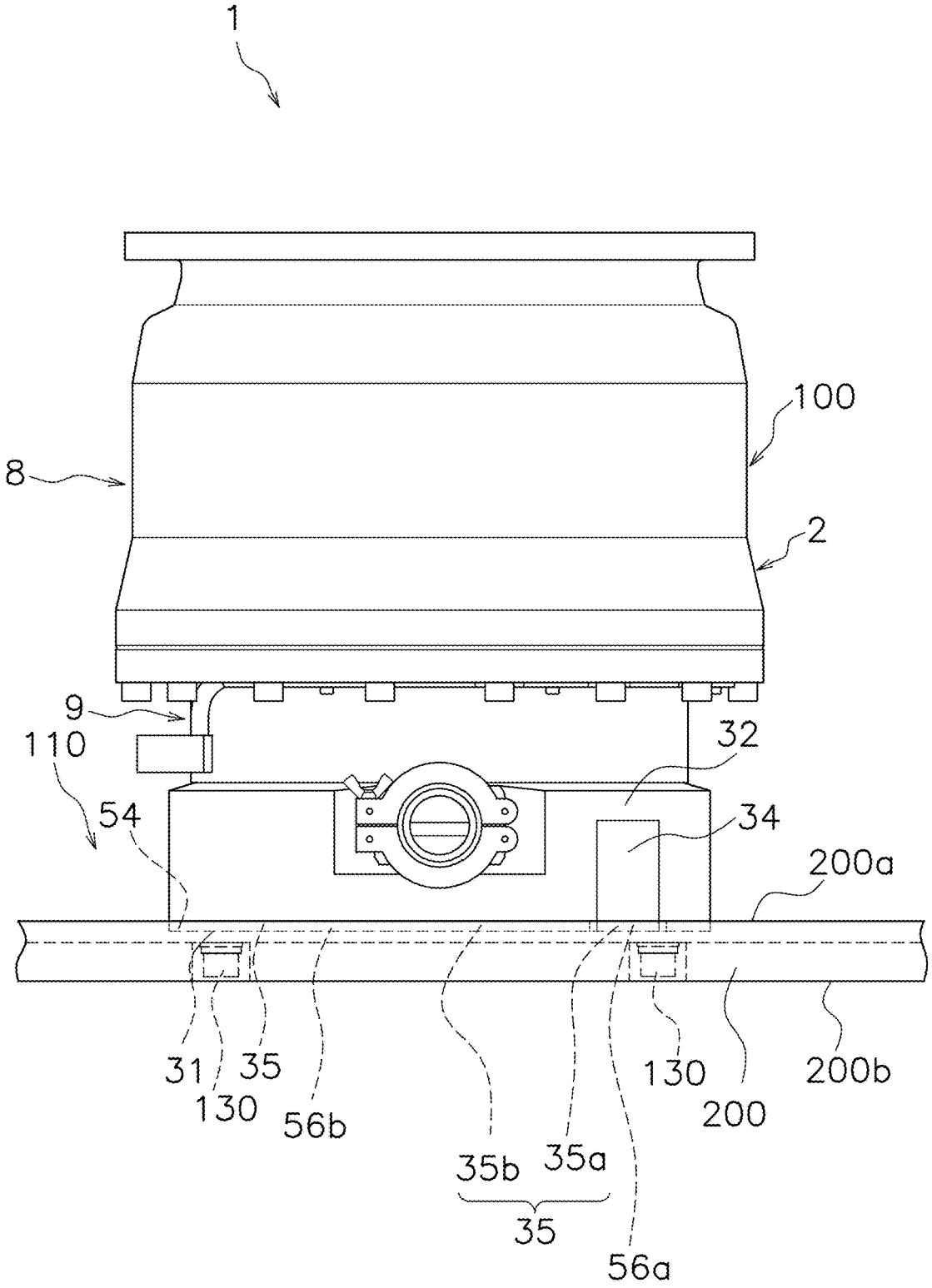
FIG. 9 is a front view of a vacuum pump according to a modification of the embodiment of the present invention.

In the above-described embodiment, the vacuum pump main body 100 is fixed to the fixing target 200 through the bottom fixing plate 120, but as shown in FIG. 9, may be directly fixed to the fixing target 200. In this case, the recessed portion 54 in which the fixing-side flat surface 56*a* is formed is formed in a front surface 200*a* of the fixing target 200. The pump fixing bolt 130 is inserted into the fixing target 200 from a back surface 200*b* side. As described above, the pump-side flat surface 34 of the vacuum pump main body 100 may face the fixing-side flat surface 56*a* of the fixing target 200.

In the above-described embodiment, there is the clearance between the inner peripheral surface 56 of the bottom fixing plate 120 and the side lower end portion 35, but the side lower end portion 35 of the vacuum pump main body 100 and the inner peripheral surface 56 of the bottom fixing plate 120 may contact each other with no clearance formed partially or entirely therebetween. Alternatively, the pump-side flat surface 34 and the fixing-side flat surface 56*a* may contact each other with no clearance therebetween.

ASPECTS

Those skilled in the art understand that the above-described plurality of exemplary embodiments are specific examples of the following aspects.

(First Item) A vacuum pump according to a first aspect includes a vacuum pump main body and a bottom fixing member. The vacuum pump main body has a bottom surface and a side surface. The side surface has a first flat surface formed so as to extend from the bottom surface. The bottom fixing member is fastened to the bottom surface of the vacuum pump main body. The bottom fixing member has a second flat surface facing the first flat surface.

According to the vacuum pump of the first item, when a rotor of the vacuum pump main body is broken down, the first flat surface of the vacuum pump main body contacts the second flat surface of the bottom fixing member. With this configuration, the bottom fixing member can receive, by the surface, breakdown torque generated on the vacuum pump main body, and breakdown torque on a second fastening member used for fixing the bottom fixing member and a fixing target to each other can be reduced. Thus, the number of second fastening members can be decreased, the strength can be lowered, and a bolt pitch circle diameter (diameter of a circle having, as a radius, a length from the center axis of the rotor to a bolt) can be decreased. As a result, a bottom-side fixing structure of the vacuum pump can be reduced in size.

(Second Item) In the vacuum pump according to the first item, the bottom fixing member may have a recessed portion in which the bottom surface of the vacuum pump main body is fitted. The recessed portion may have a mount surface on which the bottom surface is mounted and an inner peripheral surface arranged at the periphery of the mount surface. The second flat surface may be arranged at the inner peripheral surface.

According to the vacuum pump of the second item, when the rotor is broken down, the first flat surface of the vacuum pump main body contacts the second flat surface formed at the inner peripheral surface of the recessed portion, and therefore, the bottom fixing member can receive the breakdown torque by the surface.

(Third Item) In the vacuum pump according to the first item, the bottom surface and the bottom fixing member may be fastened to each other with a first fastening member. The first fastening member may be arranged in parallel with the first flat surface.

According to the vacuum pump of the third item, when the rotor is broken down, breakdown torque on the first fastening member for fastening the vacuum pump main body and the bottom fixing member to each other can be reduced.

(Fourth Item) In the vacuum pump according to the first item, the bottom fixing member may be fastened, on the outside of the bottom surface, to a fixing target with a second fastening member. The second fastening member may be arranged in parallel with the first flat surface.

According to the vacuum pump of the fourth item, when the rotor is broken down, breakdown torque on the second fastening member for fastening the bottom fixing member and the fixing target to each other can be reduced.

(Fifth Item) In the vacuum pump according to the fourth item, the bottom fixing member may have a through-hole through which the second fastening member passes. The second fastening member may be inserted into the fixing target through the through-hole. A clearance between the first flat surface and the second flat surface may be smaller than a clearance between the inner peripheral surface of the through-hole and the second fastening member.

According to the vacuum pump of the fifth item, when the rotor is broken down, the first flat surface contacts the second flat surface before the second fastening member contacts the inner peripheral surface of the through-hole, and therefore, breakdown torque on the fastening member can be reduced.

(Sixth Item) A vacuum pump according to a second aspect includes a bottom surface and a side surface. The bottom surface is fastened to a fixing target. The side surface has a first flat surface formed so as to extend from the bottom surface. The first flat surface faces a second flat surface formed at the fixing target in a state in which the bottom surface is fastened to the fixing target.

According to the vacuum pump of the sixth item, when a rotor of a vacuum pump main body is broken down, the first flat surface of the vacuum pump main body contacts the second flat surface of the bottom fixing member. With this configuration, the bottom fixing member can receive, by the surface, breakdown torque generated on the vacuum pump main body, and breakdown torque on a fastening member for fastening the bottom fixing member and the vacuum pump main body to each other or breakdown torque on a fastening member used for fixing the bottom fixing member and the fixing target to each other can be reduced. Thus, the numbers of first fastening members and second fastening members can be decreased, the strength can be lowered, and a bolt pitch circle diameter (diameter of a circle having, as a radius, a length from the center axis of the rotor to a bolt) can be decreased. As a result, a bottom-side fixing structure of the vacuum pump can be reduced in size.

What is claimed is:

1. A vacuum pump comprising:

a vacuum pump main body having a bottom surface and a side surface with a first flat surface formed so as to extend from the bottom surface; and a bottom fixing member fastened to the bottom surface of the vacuum pump main body, wherein the bottom fixing member has a second flat surface facing the first flat surface, and the bottom surface and the bottom fixing member are fastened to each other with a first fastening member, and the first fastening member is arranged in parallel with the first flat surface.

2. The vacuum pump according to claim 1, wherein the bottom fixing member has a recessed portion in which the bottom surface of the vacuum pump main body is fitted, the recessed portion has a mount surface on which the bottom surface is mounted and an inner peripheral surface arranged at a periphery of the mount surface, and the second flat surface is arranged at the inner peripheral surface.

3. A vacuum pump comprising:

a vacuum pump main body having a bottom surface and a side surface with a first flat surface formed so as to extend from the bottom surface; and a bottom fixing member fastened to the bottom surface of the vacuum pump main body, wherein the bottom fixing member has a second flat surface facing the first flat surface, the bottom fixing member is fastened, on an outside of the bottom surface, to a fixing target with a second fastening member, and the second fastening member is arranged in parallel with the first flat surface.

4. The vacuum pump according to claim 3, wherein the bottom fixing member has a through-hole through which the second fastening member passes, the second fastening member is inserted into the fixing target through the through-hole, and a clearance between the first flat surface and the second flat surface is smaller than a clearance between an inner peripheral surface of the through-hole and the second fastening member.

* * * * *